US011274667B2

(12) United States Patent
Nakazono et al.

(10) Patent No.: US 11,274,667 B2
(45) Date of Patent: Mar. 15, 2022

(54) PUMP DEVICE

(71) Applicant: HITACHI AUTOMOTIVE SYSTEMS, LTD., Hitachinaka (JP)

(72) Inventors: Tomohiko Nakazono, Fujisawa (JP); Yukio Uchida, Atsugi (JP); Satoshi Muramatsu, Atsugi (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 119 days.

(21) Appl. No.: 16/644,887

(22) PCT Filed: Aug. 22, 2018

(86) PCT No.: PCT/JP2018/030899
§ 371 (c)(1),
(2) Date: Mar. 5, 2020

(87) PCT Pub. No.: WO2019/049660
PCT Pub. Date: Mar. 14, 2019

(65) Prior Publication Data

US 2020/0284255 A1 Sep. 10, 2020

(30) Foreign Application Priority Data

Sep. 7, 2017 (JP) ..... JP2017-171884

(51) Int. Cl.
*F03C 2/00* (2006.01)
*F03C 4/00* (2006.01)
(Continued)

(52) U.S. Cl.
CPC ..... *F04C 15/0088* (2013.01); *F04C 2/344* (2013.01); *F04C 14/223* (2013.01); *F04C 15/0003* (2013.01); *F04C 2240/54* (2013.01)

(58) Field of Classification Search
CPC ..... F04C 2/344; F04C 2/3441; F04C 14/223; F04C 14/226; F04C 15/003;
(Continued)

(56) References Cited

U.S. PATENT DOCUMENTS 4,033,642 A * 7/1977 Sorgatz ..... F16F 1/02 384/215
5,538,400 A * 7/1996 Konishi ..... F04C 14/226 418/26
(Continued)

FOREIGN PATENT DOCUMENTS

JP 09166094 A * 6/1997
JP 2011-127538 A 6/2011

OTHER PUBLICATIONS

JP-09166094-A—Iwata et al.—Oil Pump—Jun. 24, 1994—English Translation (Year: 1997).*
(Continued)

*Primary Examiner* — Theresa Trieu
(74) *Attorney, Agent, or Firm* — Foley & Lardner LLP

(57) ABSTRACT

A pump device includes: a drive shaft; a pump element; a pump housing including; a pump element receiving space, first and second bearing receiving spaces, a suction passage, a discharge passage, a return passage, and a seal receiving space, a first bearing including a first lubrication groove, received within the first bearing receiving space, and supporting the drive shaft; a second bearing which includes a second lubrication groove having a sectional area that is perpendicular to the rotation axis, and that is greater than a sectional area of the first bearing that is perpendicular to the rotation axis, which is received within the second bearing receiving space, and which supports the drive shaft; and a
(Continued)

seal member provided within the seal receiving space, and arranged to seal between the drive shaft and the pump housing.

11 Claims, 8 Drawing Sheets

(51) Int. Cl.

| | |
|---|---|
| ***F04C 2/00*** | (2006.01) |
| ***F04C 15/00*** | (2006.01) |
| ***F04C 2/344*** | (2006.01) |
| ***F04C 14/22*** | (2006.01) |

(58) Field of Classification Search
CPC ..... F04C 15/0038; F04C 15/0088; F04C 2240/54; F16C 33/04; F16C 33/1065; F16C 33/107
See application file for complete search history.

(56) References Cited

U.S. PATENT DOCUMENTS

| | | | | |
|---|---|---|---|---|
| 5,938,344 | A * | 8/1999 | Sabin | F16C 17/035 384/278 |
| 8,690,557 | B2 | 4/2014 | Tada | |
| 2007/0280842 | A1 * | 12/2007 | Ueki | F04C 14/226 418/26 |

OTHER PUBLICATIONS

International Search Report with English translation issued in corresponding application No. PCT/JP2018/030899 dated Nov. 20, 2018.
Written Opinion with English translation issued in corresponding application No. PCT/JP2018/030899 dated Nov. 20, 2018.

* cited by examiner

PUMP DEVICE

TECHNICAL FIELD

This invention relates to a pump device including a pump element arranged to be driven and rotated by a drive shaft.

BACKGROUND ART

A variable displacement vane pump described in Japanese Patent Application Publication No. 2011-127538 (patent document 1) is known as a background art of this technical field.

The variable displacement vane pump includes a drive shaft having a first end side rotatably supported by a first bearing received in a bearing holding portion provided to a first housing, and a second end side rotatably supported by a second bearing received within a bearing recessed portion provided to the second housing (paragraph [0020]). The first bearing and the second bearing are lubricated by a hydraulic fluid leaked from pump chambers through axial gaps formed at both end surface portions of the rotor. A seal holding groove is provided at an end portion of the bearing holding portion receiving the first bearing. The seal holding groove has a stepped portion having diameters increased toward the outside of the first housing. A seal member is disposed in the seal holding groove so as to liquid-tightly seal (so that the fluid does not pass through) between the inner circumference surface of the first housing and the outer circumference surface of the drive shaft (paragraph [0021]).

PRIOR ART DOCUMENT

Patent Document

Patent Document 1: Japanese Patent Application Publication No. 2011-127538

SUMMARY OF THE INVENTION

Problems which the Invention is Intended to Solve

In the variable displacement vane pump of the patent document 1, the seal member is disposed on a side toward the outside of the first housing with respect to the first bearing so as to prevent the leakage of the hydraulic fluid lubricating the first bearing to the outside of the first housing. When the hydraulic fluid is the high temperature and the high pressure, the hydraulic fluid passes through a minute clearance between contact portions of the drive shaft and the seal member, so that the hydraulic fluid is easy to leak to the outside of the housing. Accordingly, it is necessary to use the seal member having a high performance or a complicated structure for preventing the leakage of the hydraulic fluid. In this case, the cost of the seal member becomes high. The size of the seal member is increased. Alternatively, in a case where the contact force between the seal member and the drive shaft is increased for preventing the leakage of the hydraulic fluid, the frictional resistance force acted to the drive shaft is increased, so that the efficiency of the pump device may be deteriorated, or the temperature of the hydraulic fluid may be increased due to the heat generation by the friction.

It is an object of the present invention to provide a pump device devised to effectively suppress the leakage of the hydraulic fluid by a simple configuration.

Means for Solving the Problem

In one aspect according to the present invention, the pump device has a following configuration.

The pump device includes a first bearing and a second bearing rotatably supporting a drive shaft arranged to drive and rotate a pump element. The first bearing includes a first lubrication groove. The second bearing includes a second lubrication groove. A sectional area of a section of the second lubrication groove which is perpendicular to the rotation axis is greater than a sectional area of a section of the first lubrication groove which is perpendicular to the rotation axis.

Benefit of the Invention

By the present invention, it is possible to effectively suppress the leakage of the hydraulic fluid by the simple configuration.

DESCRIPTION OF EMBODIMENTS

Hereinafter, a support device of a power transmission shaft according to one embodiment of the present invention is explained in detail with reference to the drawings. A variable displacement vane pump is explained as the pump device according to the embodiment. The pump device may be another pump device including a similar bearing structure. Moreover, the variable displacement vane pump according to this embodiment is applicable to a hydraulic source of a power steering device for a vehicle.

Figure 1:
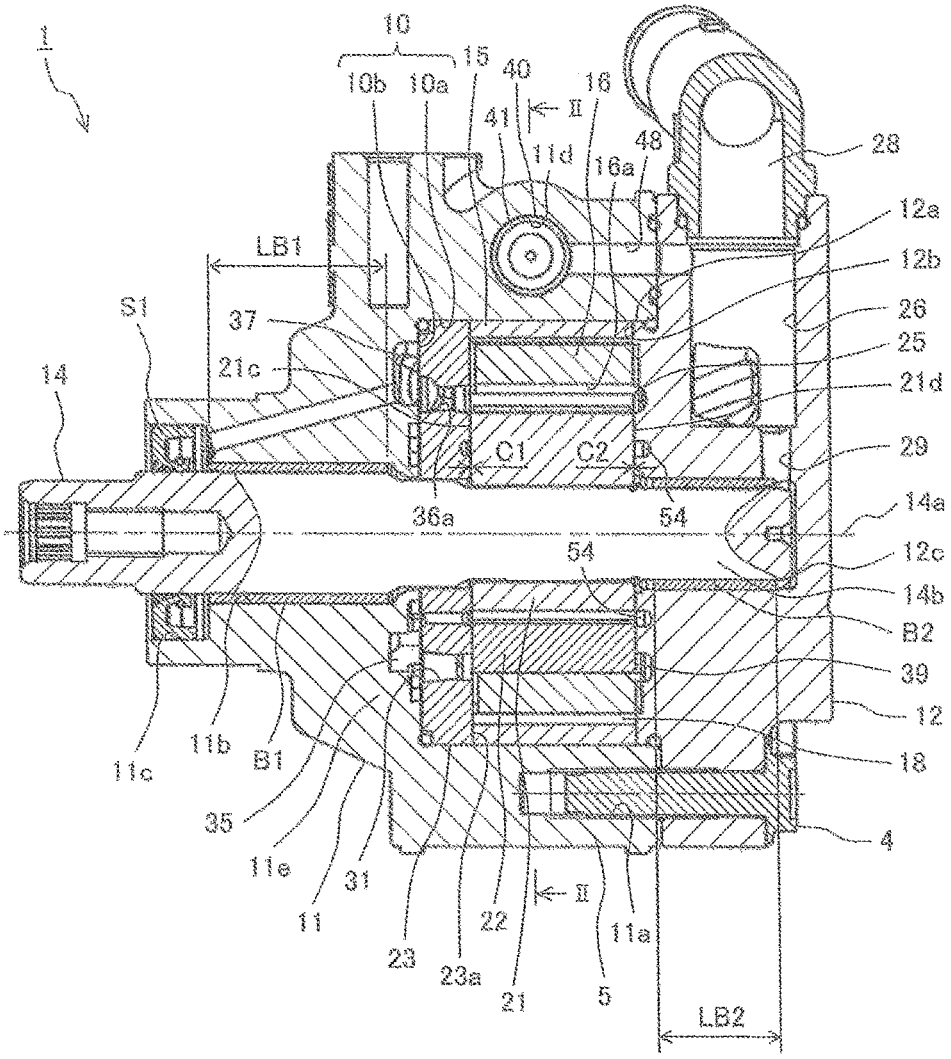
FIG. 1 is a sectional view which shows an overall variable displacement vane pump according to one embodiment of the present invention, and which includes a section that is parallel to a rotation axis of a drive shaft, and that includes the rotation axis.
Figure 2:
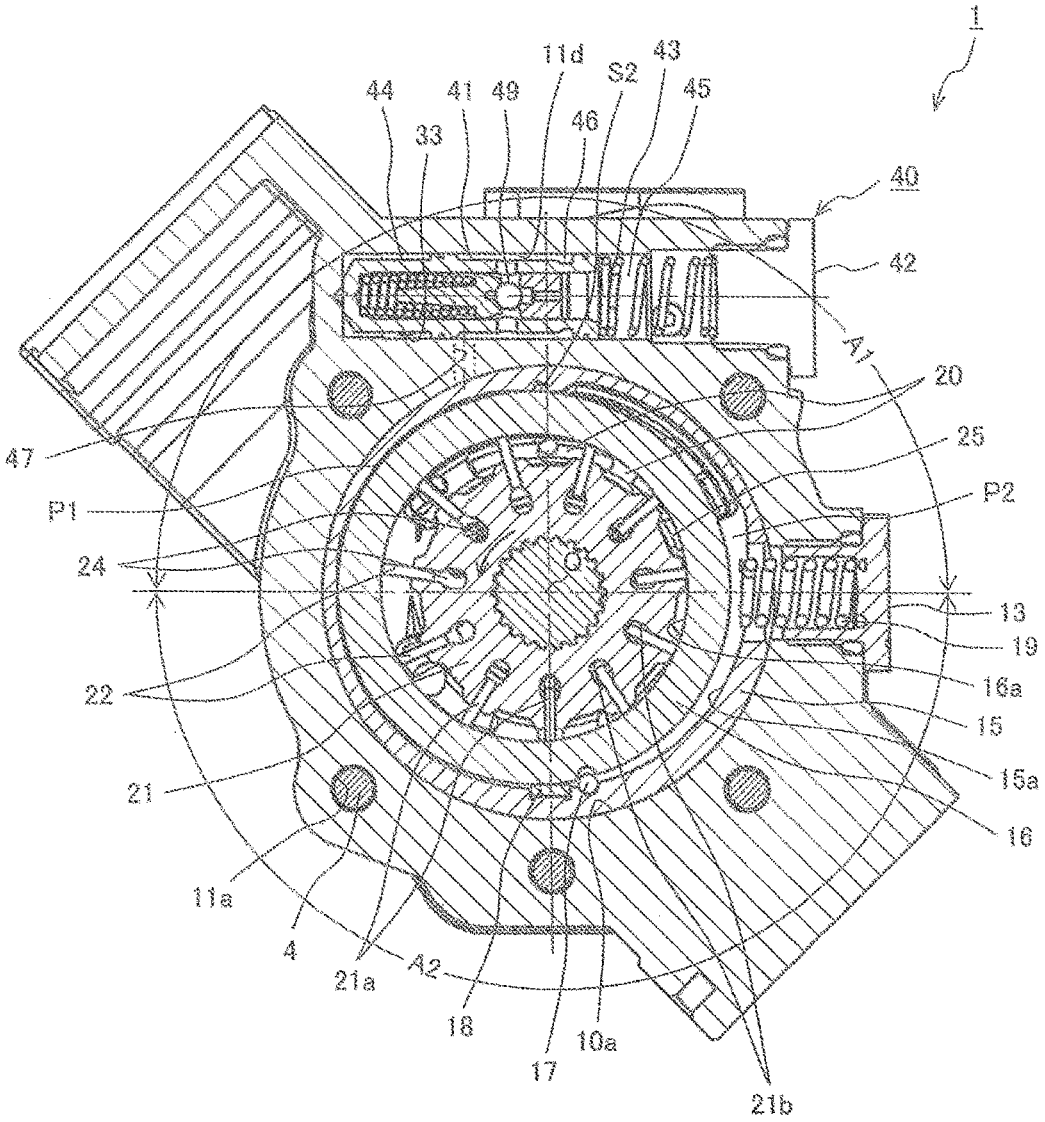
FIG. 2 is a sectional view taken along II-II in FIG. 1.

FIG. 1 is a sectional view which shows an overall variable displacement vane pump according to one embodiment of the present invention, and which includes a section that is parallel to a rotation axis of a drive shaft, and that includes the rotation axis. FIG. 2 is a sectional view taken along II-II in FIG. 1.

In this specification, a direction along a rotation axis 14*a* of a drive shaft 14 is referred to as a rotation axis 14*a* direction. A left side of FIG. 1 in the rotation axis 14*a* direction is referred to as a front side. A right side of FIG. 1 in the rotation axis 14*a* direction is referred to as a rear side. These front side and rear side do not mean a front side and a rear side of the vehicle in which the variable displacement vane pump is mounted on the vehicle. In the explanations, a radial direction around the rotation axis 14*a* (a direction perpendicular to the rotation axis 14*a*) is referred to merely as a radial direction. Moreover, an outside of a position or a member in the radial direction is referred to as an outer circumference side. An inside of the position or the member in the radial direction is referred to as an inner circumference side.

As shown in FIG. 1 and FIG. 2, the variable displacement vane pump includes a pump housing including a housing main body 11, and a rear body 12 which is a closing member; an adapter ring 15 mounted and fit in a receiving space (receiving chamber) of a cylindrical portion 5; a cam ring 16 arranged to be swung in the leftward and rightward directions of FIG. 2 within a substantially elliptical space of the adapter ring 15; the drive shaft 14 which is disposed radially inside the cam ring 16, and which is rotatably supported within the pump housing through bearings B1 and B2; and a rotor 21 which is rotatably disposed within the cam ring 16, and which is connected to the drive shaft 14.

In this embodiment, the pump element includes the adapter ring 15; the cam ring 16; the rotor 21; and vanes 22. The adapter ring 15 is disposed radially outside the cam ring 16. The cam ring 16 is disposed radially inside the adapter ring 15. The rotor 21 has a substantially disc shape. The rotor 21 is rotatably received radially inside the cam ring 16. The rotor 21 is arranged to be driven and rotated by the drive shaft 14. Each of the vanes 22 has a rectangular plate shape. The vanes 22 are provided in an outer circumference portion of the rotor 21 along the radial directions. The receiving space 10 is a receiving space (pump element receiving space) for the pump element.

The pump housing includes the front side housing main body 11 including a bottomed cylindrical portion 5; and the rear side rear body 12 closing an opening end of the cylindrical portion 5. The pump housing is constituted by abutting the housing main body 11 and the rear body 12. The housing main body 11 and the rear body 12 are made, respectively, from the aluminum alloy. In this embodiment, the housing main body 11 constitutes a first housing of the pump housing. The rear body 12 constitutes a second housing of the pump housing.

The drive shaft 14 includes a first end side in the direction of the rotation axis 14*a*. The first end side of the drive shaft 14 is rotatably supported by the first bearing B1 received within a first bearing receiving space (first bearing holding hole) lib provided to the housing main body (the first housing) 11. On the other hand, the drive shaft 14 includes a second end side which is rotatably supported by the second bearing B2 received within a drive shaft receiving hole (drive shaft receiving hole) 12*c* formed on an end surface of a mounting raised portion of the rear body (the second housing) 12. In this way, the drive shaft receiving hole 12*c* constitutes a second bearing receiving space (second bearing receiving hole) receiving the second bearing B2.

The first bearing receiving space 11*b* is provided on the first side of the receiving space 10 in the direction of the rotation axis 14*a* of the drive shaft 14. On the other hand, the drive shaft receiving hole 12*c* is provided on the second side of the receiving space 10 in the direction of the rotation axis 14*a* of the drive shaft 14.

Each of the first bearing B1 and the second bearing B2 is a bush having a cylindrical shape. The first bearing (bush) B1 includes an outer circumference surface abutted on an inner circumference surface of the first shaft receiving space 11*b*; and an inner circumference surface abutted on an outer circumference surface of the drive shaft 14. The second bearing (bush) B2 includes an outer circumference surface abutted on an inner circumference surface of the drive shaft receiving hole 12*c*; and an inner circumference surface abutted on the outer circumference surface of the drive shaft 14. Besides, the bush is a bush explained in FI: F16C33/04.

The housing main body 11 constitutes the receiving space 10. The rear body 12 constitutes a cover member closing the receiving space 10. The receiving space 10 includes a circumferential wall (inner circumference surface) 10*a*; and an end surface 10*b* along radial directions around the rotation axis 14*a*. The circumferential wall 10*a* and the end surface 10*b* form a zo recessed portion which is recessed from the rear side end surface of the housing main body 11 toward the front side.

Bolt internal screw holes 11*a* are formed around the opening of the recessed portion forming the receiving space 10. A plurality of bolts (five bolts in this embodiment) for jointing the rear body 12 are screwed in the bolt internal screw holes 11*a*. Moreover, the cylindrical portion 5 receives a pressure plate 23 which is positioned on the end surface (the inner bottom surface) 10*b* side of the bottom portion lie opposite to the opening end of the rear side, and which sandwiches and holds the cam ring 16 and the rotor 21 with the rear body 12. The pressure plate 23 is made from the iron series metal into a substantially disc shape. Moreover, the pressure plate 23 may be made from the aluminum alloy.

The rear body 12 includes a disc shaped protrusion portion 12*a* which is integrally provided on the end surface of the rear body 12 on the rotor 21 side. The protruding portion 12*a* is mounted in the inner circumference surface of the opening end of the receiving space 10 of the cylindrical portion 5. With this, the rear body 12 is positioned in the radial direction at the assembling operation to the housing main body 11. Moreover, the protruding portion 12*a* includes the drive shaft receiving hole (drive shaft receiving hole) 12*c* formed on the tip end surface 12*b* side of the protruding portion 12*a*. The drive shaft receiving hole 12*c* rotatably receives the one end portion 14*b* of the drive shaft 14.

The drive shaft receiving hole (the drive shaft receiving hole) 12*c* is formed along the rotation axis 14*a* am from the tip end surface 12*b* to a side (rear side) opposite to the housing main body 11 side. An end portion of the drive shaft receiving hole 12*c* on the rear side is closed. The drive shaft receiving hole 12*c* is a bottomed recessed portion. Vane back pressure grooves 54 and 54 are formed is on the tip end surface 12*b* radially outside (on the outer circumference side in the radial direction around the rotation axis 14*a*) the drive shaft receiving hole 12*c*. The vane back pressure grooves 54 and 54 are formed at symmetrical positions in the radial direction. Each of the vane back pressure grooves 54 and 54 has a substantially arc shape. The vane back pressure grooves 54 and 54 are connected, respectively, to back pressure chambers described later.

As shown in FIG. 1, the bottom side of the drive shaft receiving hole 12*c* is connected though a connection hole 29 to a suction hole 26. With this, the hydraulic fluid lubricates between the inner circumference surface of the drive shaft receiving hole 12*c* and the outer circumference surface of the one end portion 14*b* of the drive shaft 14. Moreover, the hydraulic fluid leaked from the pump chambers 20 through an axial clearance C2 formed between an end surface 21*d* of the rotor 21 on the rear body 12 side, and the tip end surface 12*b* of the rear body 12 flows into the drive shaft receiving hole 12*c*. That is, the hydraulic fluid is supplied to the drive shaft receiving hole 12*c* by the connection hole 29 and the axial clearance C2. The hydraulic fluid supplied to the drive shaft receiving hole 12*c* lubricates between the inner circumference surface of the second bearing (bush) B2, and the outer circumference surface of the drive shaft 14.

On the other hand, the first bearing B1 is lubricated by the hydraulic fluid leaked from the pump chambers 20 through an axial clearance Cl formed between an end surface 21*c* of the rotor 21 on the front side, and an end surface 23*a* of the pressure plate 23 on the rear side. Moreover, there is provided a seal receiving space (seal holding groove) 11*c* arranged to have a stepped portion to increase a diameter from the first bearing receiving space 1 lb of the housing main body 11 to the front side. A seal member S1 is disposed within the seal receiving space 11*c* to liquid-tightly seal between the inner circumference surface of the seal receiving space 11*c* of the housing main body 11, and the outer circumference surface of the drive shaft 14. That is, the seal member S1 seals between the drive shaft 14 and the pump housing. With this, it is possible to suppress the leakage of the hydraulic fluid lubricating the first bearing B1 to the outside.

The adapter ring 15 is integrally made from the iron series metal. As shown in FIG. 2, the adapter ring 15 is provided with a position holding pin 17 which is disposed in an arc support groove formed at a lower portion of the elliptic inner circumference surface 15*a*, and which is arranged to hold the position of the cam ring 16. Moreover, a plate member 18 is provided on the inner circumference surface 15*a* near a left side of the position holding pin 17 in the drawing, that is, a first fluid pressure chamber P1 (described later) side. The plate member 18 has a predetermined width. The plate member 18 serves as a swing fulcrum of the cam ring 16. Besides, the position holding pin 17 is not the swing fulcrum of the cam ring 16. The position holding pin 17 is arranged to hold the position of the cam ring 16, and to retain the rotation of the cam ring 16 with respect to the adapter ring 15.

The cam ring 16 is made from the iron series metal into a substantially annular shape. The cam ring 16 is disposed within the receiving space 10 to be eccentric to the rotor 21. The cam ring 16 separates a first fluid pressure chamber P1 and a second fluid pressure chamber P2 between the cam ring 16 and the adapter ring 15 by the position holding pin 17 and a seal member S2 positioned at a position substantially opposite to the position holding pin 17. Moreover, the cam ring 16 is arranged to be swung between the first fluid pressure chamber P1 side and the second fluid pressure chamber P2 side around a predetermined position of the support surface (the plate member) 18 of the adapter ring 15.

The first fluid pressure chamber P1 and the second fluid pressure chamber P2 are a pair of spaces which are formed within the pump housing between the cam ring 16 and the receiving space 10 in the radial direction around the rotation axis 14*a*. In particular, the first fluid pressure chamber P1 and the second fluid pressure chamber P2 are formed between the outer circumference of the cam ring 16 and the inner circumference of the adapter ring 15.

The first fluid pressure chamber P1 is provided on a side on which an internal volume is decreased when the cam ring 16 is moved in a direction in which the eccentric amount between the center of the inner circumference edge of the cam ring 16 and the rotation axis 14*a* is increased. The second fluid pressure chamber P2 is provided on a side on which an internal volume is increased when the cam ring 16 is moved in a direction in which the eccentric amount between the center of the inner circumference edge of the cam ring 16 and the rotation axis 14*a* is increased. Besides, the center of the inner circumference edge of the cam ring 16 means a center point of the inner circumference edge of the cam ring 16 in a section perpendicular to the rotation axis 14*a*.

The rotor 21 is arranged to be rotated in an arrow direction (counterclockwise direction) of FIG. 2 when the driven shaft 14 is driven and rotated by a crank shaft of an internal combustion engine (not shown). That is, the rotor 21 is arranged to be driven and rotated by the drive shaft 14. Moreover, the rotor 21 includes a plurality of slits (slots) 21*a* which are formed in the outer circumference portion of the rotor 21 at a regular interval in the circumferential direction, and which extend in the radial directions. The vanes 22 are held within the respective slits 21*a* to be projectable and retractable in the radial directions in the direction of the inner circumference surface 16*a* of the cam ring 16. That is, the vanes 22 are arranged to be moved within the slits 21*a* in the radial directions. A back pressure groove 21*b* is formed at an inner circumference side end portion of each of the slits 21*a*. The back pressure grooves 21*b* are connected to the slits 21*a*. With this, a back pressure chamber 24 is formed at the inner circumference side end portion of each of the slits 21*a*. Each of the back pressure chambers 24 is defined to have a boundary defined by the back pressure groove 21*b* and the base end portion (the inner circumference side end portion) of the vane 22. Each of the back pressure chambers 24 has a substantially circular shape.

A plurality of pump chambers 20 are formed by adjacent two of the vanes 22 in a space formed between the cam ring 16 and the rotor 21. The volumes of the pump chambers 20 are increased or decreased by swinging the cam ring 16 around the plate member 18 serving as the swing furculum.

As shown in FIG. 2, a spring 19 is disposed on the second fluid pressure chamber P2 side of the housing main body 11. The spring 19 is an urging member including one end supported by a bolt-shaped spring retainer 13. The cam ring 16 is arranged to be constantly urged by the spring 19 on the first fluid pressure chamber P1 side, that is, in a direction in which the volumes of the pump chambers 20 are maximized.

The rear body 12 includes a first port 25 which has an arc shape, and which is formed in a suction region A1 in which the volumes of the pump chambers 20 are gradually increased in accordance with the rotation of the rotor 21. The first port 25 constitutes a suction port arranged to suck the hydraulic fluid into the pump chambers 20. The first port 25 is arranged to supply the hydraulic fluid sucked from the reservoir tank through the suction hole 26 and a suction passage portion 28 including a portion formed in the rear body 12, to the pump chambers 20. Accordingly, the first port 25, the suction passage portion 28, and the suction hole 26 are connected to the receiving space 10. The first port 25, the suction passage portion 28, and the suction hole 26 constitute a suction passage arranged to supply the hydraulic fluid to the receiving space 10 in accordance with the rotation of the drive shaft 14.

Moreover, the rear body 12 includes a second port 39 which has an arc shape, which is formed at a position opposite to the first port 25 with respect to the drive shaft receiving hole 12*c* in a discharge region A2 in which the volumes of the pump chambers 20 are gradually decreased in accordance with the rotation of the rotor 21. The second port 39 constitutes a discharge port arranged to discharge the hydraulic fluid from the pump chambers 20.

Accordingly, a discharge passage connected to the second port 39 is connected to the receiving space 10. This discharge passage constitutes a passage arranged to discharge the hydraulic fluid from the receiving space 10 in accordance with the rotation of the drive shaft 14. The second port 39 constitutes a part of the discharge passage.

Besides, the connection hole 29 constitutes a return passage connecting the drive shaft receiving hole (the second shaft receiving space) 12*c* and the suction passage (the first port 25, the suction hole 26, and the suction passage portion 28).

The pressure plate 23 includes a suction hole 36*a* connecting the first port 25 and a low pressure chamber 37 formed on the end surface 10*b* of the cylindrical portion 5, through the pump chambers 20. The pressure plate 23 includes a discharge hole 31 which is formed at a position opposite to the suction hole 36*a* in the radial direction, and which connects the second port 39 and a high pressure chamber 35 that is a discharge opening formed on the end surface 10*b* of the cylindrical portion 5, through the pump chambers 20.

Accordingly, the hydraulic fluid supplied from the first port 25 and the low pressure chamber 37 to the pump chambers 20 is discharged from the pump chambers 20 whose the volumes are decreased in accordance with the rotation of the rotor 21, to the second port 39, and introduced through the discharge hole 31 to the high pressure chamber 35. The hydraulic fluid introduced to the high pressure chamber 35 is sent from the discharge passage (not shown) formed in the pump housing through pipes to a hydraulic power cylinder of the power steering device.

That is, in the variable displacement vane pump according to this embodiment, the cam ring 16 is formed into the annular shape. The cam ring 16 is arranged to be moved within the receiving space 10. The cam ring 16 forms the plurality of the pump chambers 20 with the rotor 21 and the plurality of vanes 22. In the plurality of pump chambers 20, the pump chambers 20 positioned in the suction region A1 in which the volumes are increased in accordance with the rotation of the drive shaft 14 suck the hydraulic fluid from the suction passage (the first port 25, the suction hole 26, and the suction passage portion 28). The pump chambers 20 positioned in the discharge region A2 in which the volumes are decreased in accordance with the rotation of the drive shaft 14 discharge the hydraulic fluid to the discharge passage connected to the second port 39.

One suction region A1 is provided in a predetermined region in the circumferential direction around the rotation axis 14*a*. One discharge region A2 is provided in a predetermined region in the circumferential direction around the rotation axis 14*a* on a side opposite to the suction region A1 with respect to the rotation axis 14*a* in the radial direction.

A control valve 40 is provided within an upper portion of the housing main body 40. The control valve 40 extends in a direction perpendicular to the rotation axis 14*a*. The control valve 40 is arranged to control the pressure within the first fluid pressure chamber P1 to move the cam ring 16, and thereby to variably control the amount of the hydraulic fluid discharged from the discharge region A2 at the one rotation of the rotor 21.

As shown in FIG. 2, the control valve 40 includes a valve element 41, a valve spring 43, a high pressure chamber 44, and an intermediate chamber 45. The valve element 41 is slidably received within a valve hole 11*d* formed within the housing main body 11. The valve spring 43 is arranged to urge the valve element 41 in the leftward direction of FIG. 2 so that the valve spring 43 is abutted on a plug 42 mounted to one end portion of the valve hole 11*d* on the opening side. The high pressure chamber 44 is formed between the plug 42 and a tip end portion of the valve element 41. The high pressure chamber 44 is arranged to receive the hydraulic fluid pressure on the upstream side of a metering orifice (not shown), that is, a part of the hydraulic fluid within the high pressure chamber 35 through the discharge passage 33. The intermediate chamber 45 receives the valve spring 43. The intermediate chamber 45 is arranged to receive the hydraulic fluid pressure on the downstream side of the metering orifice.

In the control valve 40, the valve element 41 is arranged to be moved in the rightward direction in FIG. 2 against the urging force of the valve spring 43 when a pressure difference between the high pressure chamber 44 and the intermediate pressure chamber 45 is equal to or greater than a predetermined value.

When the valve element 41 is positioned on the left side in FIG. 2, the first fluid pressure chamber P1 is connected through a connection passage 47 connecting the first fluid pressure chamber P1 and the valve hole 11*d*, to a low pressure chamber 46 formed radially outside the intermediate portion of the valve element 41. As shown in FIG. 1, this low pressure chamber 46 is connected to a low pressure passage 48 bifurcated from the suction hole 26. The low pressure chamber 46 is arranged to receive the low pressure hydraulic fluid (hereinafter, referred to as "suction pressure") within the suction hole 26 through the low pressure passage 48. That is, when the valve element 41 is positioned on the left side in FIG. 2, the suction pressure is introduced from the low pressure chamber 46 to the first fluid pressure chamber P1.

On the other hand, when the valve element 41 is moved in the right side in FIG. 2 by the pressure difference between the high pressure chamber 44 and the intermediate chamber 45, the first fluid pressure chamber P1 is disconnected from the low pressure chamber 46, and connected to the high pressure chamber 44. With this, the high pressure hydraulic fluid (hereinafter, referred to as "discharge pressure") within the discharge passage 33 is introduced into the first fluid pressure chamber P1. In this way, the suction pressure within the low pressure chamber 46 and the discharge pressure on the upstream side of the metering orifice are selectively supplied to the first fluid pressure chamber P1.

Besides, the control valve 40 includes a relief valve 49 constituted within the valve element 41. When the internal pressure of the intermediate pressure chamber 45 becomes equal to or greater than a predetermined value, that is, when the pressure on the load side of the outside becomes equal to or greater than the predetermined value, the relief valve 49 is opened so as to recirculate a part of the hydraulic fluid through the low pressure passage 48 to the suction hole 26. That is, when the hydraulic pressure of the power steering device becomes equal to or greater than the predetermined value, the relief valve 49 is opened so as to release the hydraulic fluid.

On the other hand, the second fluid pressure chamber P2 is arranged to be connected to the suction hole 26 through an introduction hole formed in the pressure plate 23, and thereby to constantly receive the pressure (the low pressure).

Figure 3A:
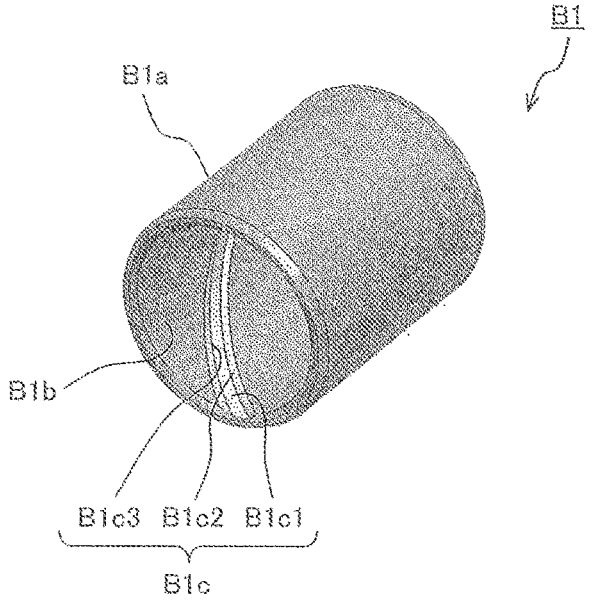
FIG. 3A is a perspective view showing an exterior of a first bearing in the one embodiment of the present invention.

FIG. 3A is a perspective view showing an exterior of a first bearing in the one embodiment of the present invention.

The first bearing B1 is constituted by a bush having a cylindrical shape. The first bearing (the bush) B1 includes a first lubrication groove B1*c* formed on the surface B1*b* on the inner circumference side (the inner circumference surface). An outer circumference surface B1*a* of the first bearing B1 is provided within the first bearing receiving space lib to be abutted on the inner circumference surface of the first bearing receiving space (the first bearing receiving hole) 11*b*. That is, the outer circumference surface B1*a* of the first bearing B1 which is the outer side surface in the radial direction around the rotation axis 14*a* is press fit in the inner circumference surface of the first bearing receiving space lib in an entire area in the circumferential direction around the rotation axis 14*a*. The first lubrication groove B1*c* has a recessed shape recessed from the inner circumference surface B1*b* in the radially outward direction. The first lubrication groove B1*c* is constituted by a bottom surface B1*c*1 and side surfaces B1*c*2 and B1*c*3.

Figure 3B:
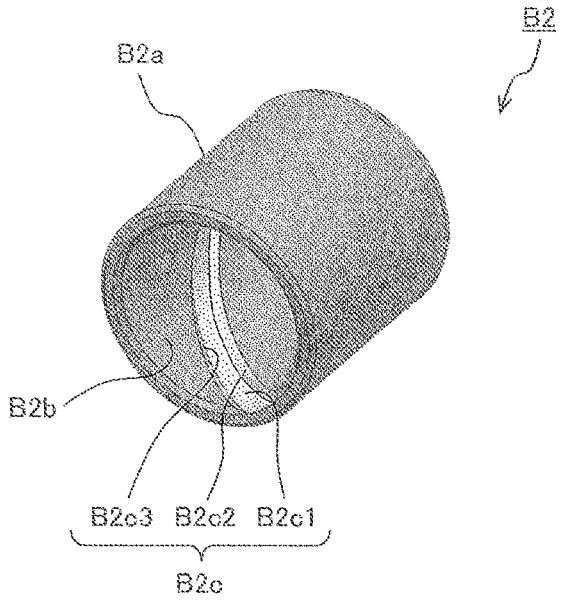
FIG. 3B is a perspective view showing an exterior of a second bearing in the one embodiment of the present invention.

FIG. 3B is a perspective view showing an exterior of a second bearing in the one embodiment of the present invention.

The second bearing B2 is constituted by a bush having a cylindrical shape. The second bearing (the bush) B2 includes a second lubrication groove B2*c* formed on the surface B2*b* on the inner circumference side (the inner circumference surface). An outer circumference surface B2*a* of the second bearing B2 is provided within the drive shaft receiving hole 12*c* to be abutted on the inner circumference surface of the drive shaft receiving hole (the second bearing receiving hole) 12*c* which is the second bearing receiving space. The outer circumference surface B2*a* of the second bearing B2 which is the outer side surface in the radial direction around the rotation axis 14*a* is press fit in the inner circumference surface of the drive shaft receiving space 12*c* in an entire area in the circumferential direction around the rotation axis 14*a*. The second lubrication groove B2*c* has a recessed shape recessed from the inner circumference surface B2*b* in the radially outward direction. The second lubrication groove B2*c* is constituted by a bottom surface B2*c*1 and side surfaces B2*c*2 and B2*c*3.

The second lubrication groove B2*c* is formed only on the inner circumference surface B2*b* side which is on the inner side in the radial direction around the rotation axis 14*a*. With this, it is possible to ensure the press-fit load since the second bearing B2 is press-fit in the drive shaft receiving hole 12*c* in the entire circumference of the outer circumference surface B2*a*.

In this embodiment, the second bearing B2 is constituted by the cylindrical bush. The second bearing B2 is not limited to the cylindrical shape as long as the second bearing B2 supports the drive shaft 14 in a range of 180 degrees or more in the circumferential direction around the rotation axis 14*a*. In this case, the second bearing B2 surrounds the semicircle region or more of the drive shaft 14. With this, it is possible to support the drive shaft 14.

In the first lubrication groove B1*c* and the second lubrication groove B2*c*, a sectional area of a section of the second lubrication groove B2*c* which is perpendicular to the rotation axis 14*a* is greater than a sectional area of a section of the first lubrication groove B1*c* which is perpendicular to the rotation axis 14*a*.

The hydraulic fluid leaked from the pump element passes through the first lubrication groove B1*c* of the first bearing B1, and reaches the seal member S1. When the fluid amount of this hydraulic fluid is much, it exceeds the sealing characteristic of the seal member S1, so that the hydraulic fluid may be leaked to the outside of the pump housing. Accordingly, the sectional area of the second lubrication groove B2*c* is set to be greater than the sectional area of the first lubrication groove B1*c* so that the more hydraulic fluid flows into the second lubrication groove B2*c* side. With this, it is possible to suppress the flow amount of the hydraulic fluid flowing into the first lubrication groove B1*c* side, and to suppress the leakage of the hydraulic fluid to the outside of the pump housing. On the other hand, the hydraulic fluid flowing into the second lubrication groove B2*c* side is returned through the connection hole 29 which is the return passage, to the suction passage (the first port 25, the suction hole 26, and the suction passage portion 28). The seal member does not exist in these passages. Accordingly, even when the flow amount of the hydraulic fluid flowing into the second lubrication groove B2*c* side is increased, the possibility of leakage of the hydraulic fluid to the outside of the pump housing is small.

It is preferable that a length LB1 of the first bearing B1 in the direction of the rotation axis 14*a* is longer than a length LB2 of the second bearing B2 in the direction of the rotation axis 14*a*. By setting the length LB1 of the first bearing B1 in the direction of the rotation axis 14*a* to the longer length, the flow passage length of the first bearing groove B1 becomes long, so that the flow passage resistance is increased. Consequently, it is possible to decrease the flow amount of the first lubrication groove B1*c* side.

Accordingly, in this embodiment, at least the first lubrication groove B1*c* has a helical shape around the rotation axis 14*a*.

Figure 4A:
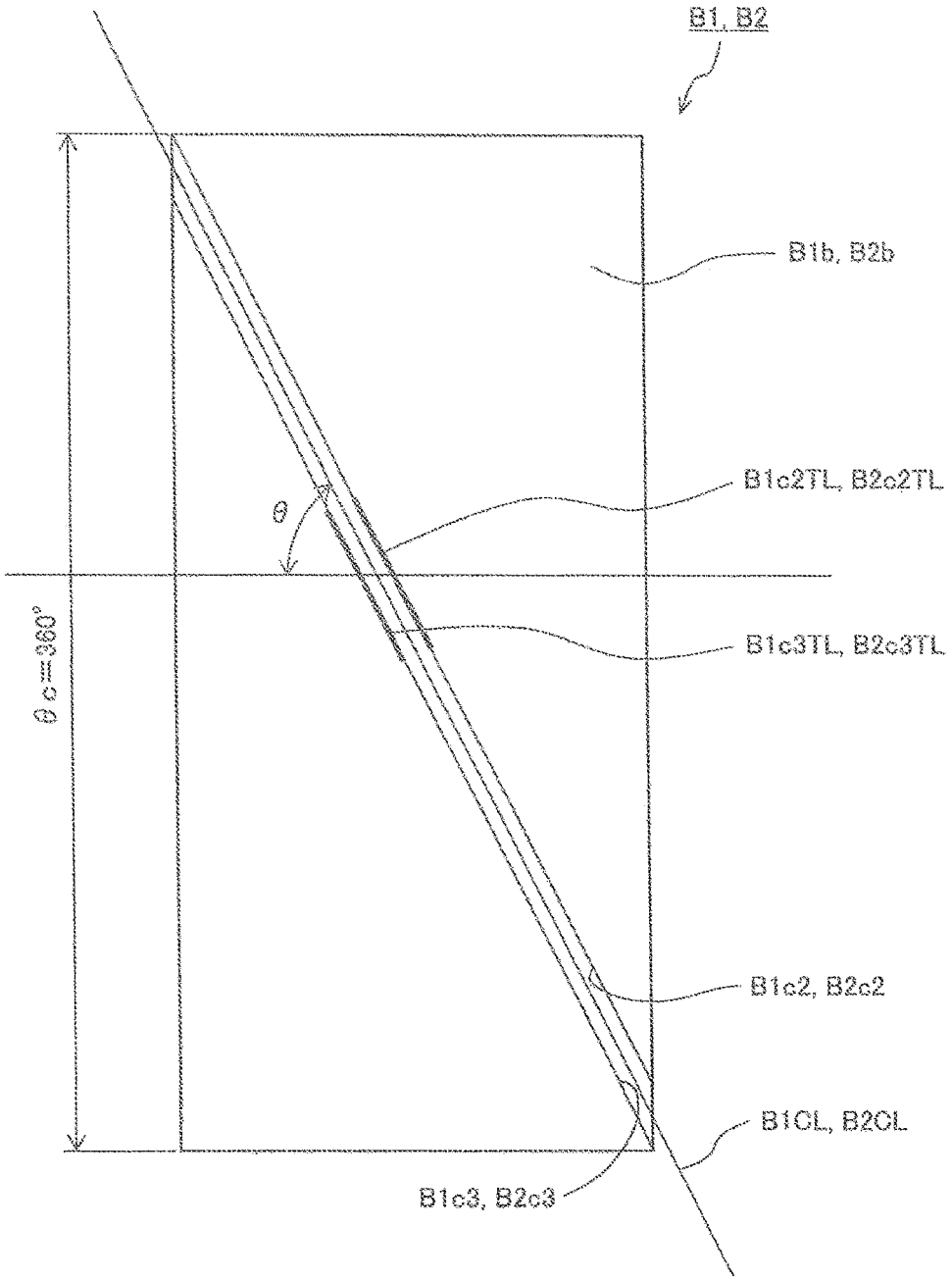
FIG. 4A is a deployed view showing an inner circumference surface of the first bearing or the second bearing when the inner circumference is deployed into the plane.

FIG. 4A is a deployment view showing the inner circumference surface of the first bearing or the second bearing when the inner circumference surface of the first bearing or the second bearing is deployed into the plane.

In this embodiment, the first lubrication groove B1*c* and the second lubrication groove B2*c* have the helical shapes around the rotation axis 14*a*. In this case, it is preferable that the flow passage resistance of the first bearing B1*c* is greater than the flow passage resistance of the second bearing B2*c*.

In FIG. 4A, the inner circumference surface B1*b* of the first bearing B1 and the inner circumference surface B2*b* of the second bearing B2 are deployed into the plane. FIG. 4A shows a state where the rotation axis 14*a* projects to the deployed plane. In this case, it is preferable that an inclination angle θ of a center line B1CL of the first lubrication groove Bl*c* with respect to the rotation axis 14*a* is greater than an inclination angle θ of a center line B2CL with respect to the rotation axis 14*a*. Besides, the center line B1CL and the center line B2CL are lines passing through groove centers (centers in the widthwise directions) of the first lubrication groove Bl*c* and the second lubrication groove B2*c*. In a case where the first lubrication groove Bl*c* and the second lubrication groove B2*c* are curved, it is preferable that inclination angles θ of tangent lines B1*c*2TL and B1*c*3TL of the curved line of the first lubrication groove Bl*c* are greater than inclination angles θ of tangent lines B2*c*2TL and B2*c*3TL of the curved line of the second lubrication groove B2*c*.

Besides, in the deployment view of FIG. 4, the first lubrication groove B1*c* and the second lubrication groove B2*c* are formed into the straight shapes. Accordingly, the tangent lines B1*c*2TL and B1*c*3TL and the tangent lines B2*c*2TL and B2*c*3TL correspond to the side surfaces B1*c*2 and B1*c*3 of the first lubrication groove B1*c* and the side surfaces B2*c*2 and B2*c*3 of the second lubrication groove B2*c*.

In a case where the inclination angle θ of the first lubrication groove B1 is greater than the second lubrication groove B2*c*, it is possible to increase the turning number of the helical groove per unit length, and to further increase the flow passage resistance of the first lubrication groove B1*c*.

Figure 4B:
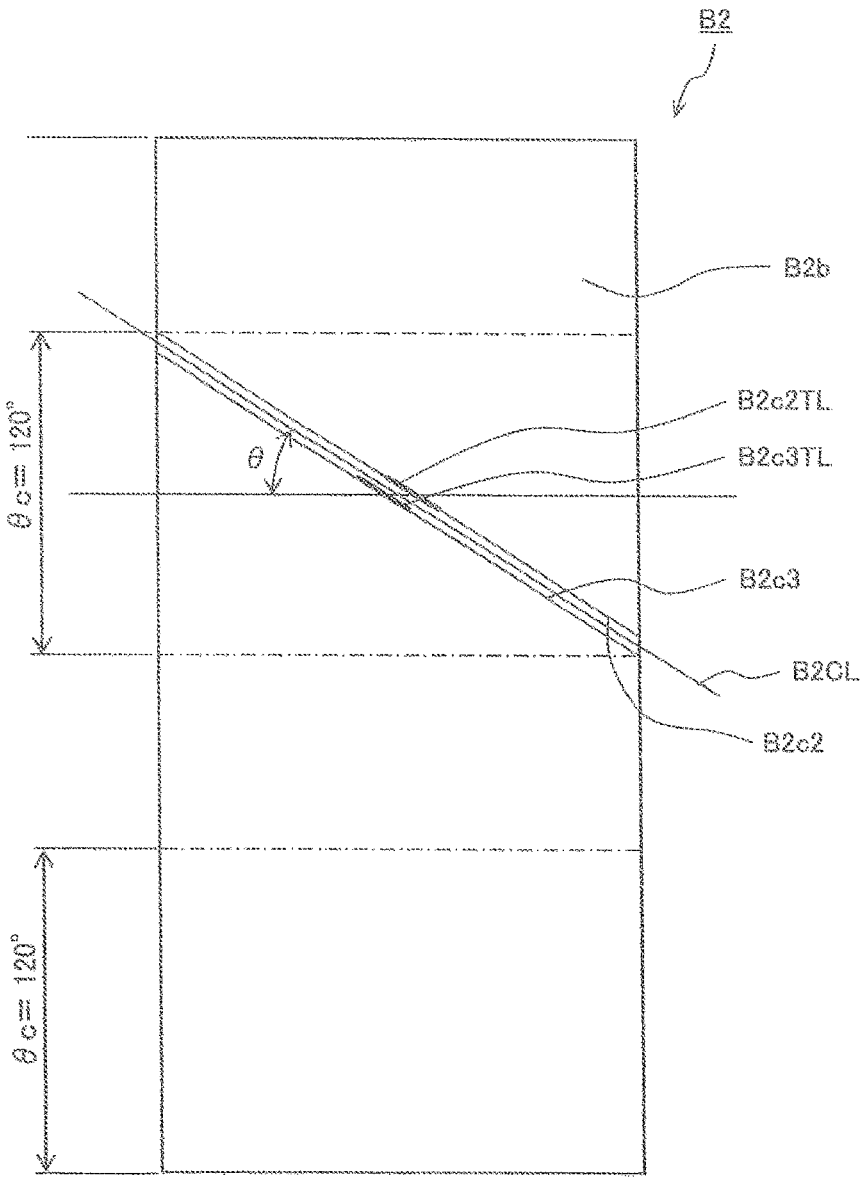
FIG. 4B is a deployed view showing the inner circumference surface of the second bearing when the inner circumference of the second bearing is deployed into the plane.

FIG. 4B is a deployment view showing the inner circumference surface of the second bearing when the inner circumference surface of the second bearing is deployed into the plane.

FIG. 4A shows an example where the first lubrication groove B1*c* is formed around the entire circumference of the inner circumference surface B1*b* of the first bearing B1, and the second lubrication groove B2*c* is formed around the entire circumference of the inner circumference surface B2*b* of the first bearing B2. Besides, in this embodiment, the second lubrication groove B2*c* is provided in a range of the center angle θc=120 degrees. In this case, the second lubrication groove B2*c* is provided on a side of the discharge region A2 in the circumferential direction around the rotation axis 14*a*. Besides, in FIG. 4B, the second lubrication groove B2*c* is not provided in the region corresponding to the suction region A1. The center angle θc at which the second lubrication groove B2*c* is provided is not limited to 120 degrees. The center angle θc can be arbitrarily set within the range of the discharge region A2.

The variable displacement vane pump includes one suction region A1 and one discharge region A2. Accordingly, the drive shaft 14 receives the discharge pressure from the discharge region A2 side toward the suction region A1 side. Consequently, the drive shaft 14 is tightly pressed against a portion of the inner circumference surface B2*b* of the second bearing B2 on the suction region A1 side. Therefore, the second lubrication groove B2*c* is not provided on the surface on the suction region A1 side against which the drive shaft 14 is tightly pressed, so as to increase the area of the pressure receiving surface. With this, the second bearing B2 can tightly receive the surface pressure from the drive shaft 14. On the other hand, the pressing force from the drive shaft 14 is small on the discharge region A2 side which is the opposite side. Accordingly, even when the pressure receiving area is small by providing the second lubrication groove B2*c*, the influence is small. Moreover, it is possible to increase the flow amount in the second lubrication groove B2*c* by increasing the sectional area of the second lubrication groove B2*c*.

Figure 5:
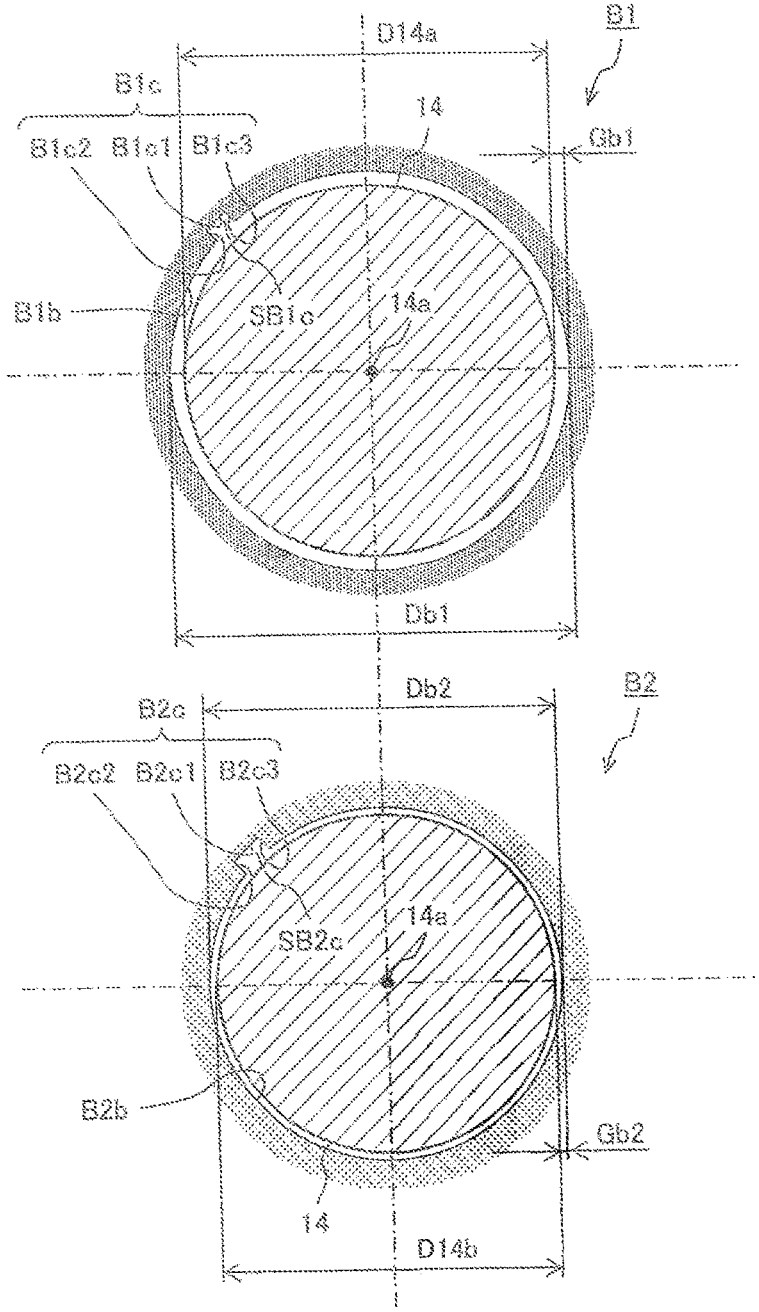
FIG. 5 is a schematic view showing a section of the first bearing, the second bearing, and the drive shaft which is perpendicular to the rotation axis of the drive shaft.

FIG. 5 is a schematic view showing a section of the first bearing, the second bearing, and the drive shaft which is perpendicular to the rotation axis of the drive shaft.

In this embodiment, an inside diameter Db1 of the first bearing B1 in the radial direction around the rotation axis 14*a* is greater than an inside diameter Db2 of the second bearing B2 in the radial direction around the rotation axis 14*a*. A pulley and so on which is a drive means is provided on the drive shaft 14 on the first bearing B1 side on which the seal member S1 is provided, so that the drive shaft 14 is pulled in the radial direction. Accordingly, the urging force from the drive shaft 14 to the first bearing B1 becomes large. However, the inside diameter Db1 of the first bearing B1 is greater than the inside diameter Db2 of the second bearing B2, so that the pressure receiving area becomes large. Consequently, it is possible to suppress the surface pressure per unit area.

Besides, in an outside diameter of the drive shaft 14, an outside diameter D14*a* of a portion of the drive shaft 14 which is supported by the first bearing B1 is greater than an outside diameter D14*b* of a portion of the drive shaft 14 which is supported by the second bearing B2.

A distance Gb1 of a gap between the inner circumference surface B1*b* of the first bearing B1 and the outer circumference surface of the drive shaft 14 in the radial direction around the rotation axis 14*a* is greater than a distance Gb2 of a gap between the inner circumference surface B2*b* of the second bearing B2 and the outer circumference surface of the drive shaft 14. The radial clearance between the first bearing B1 and the drive shaft 14 is greater than that of the second bearing B2.

Accordingly, the fluid amount of the hydraulic fluid flowing into the first lubrication groove B1*c* is dispersed to the radial clearance side, so that it is possible to decrease the flow speed of the hydraulic fluid flowing from the first lubrication groove B1*c* to the seal member S1, that is, to decrease the energy of the hydraulic fluid. Consequently, it is possible to suppress the leakage of the hydraulic fluid from the seal member S1.

Figure 6:
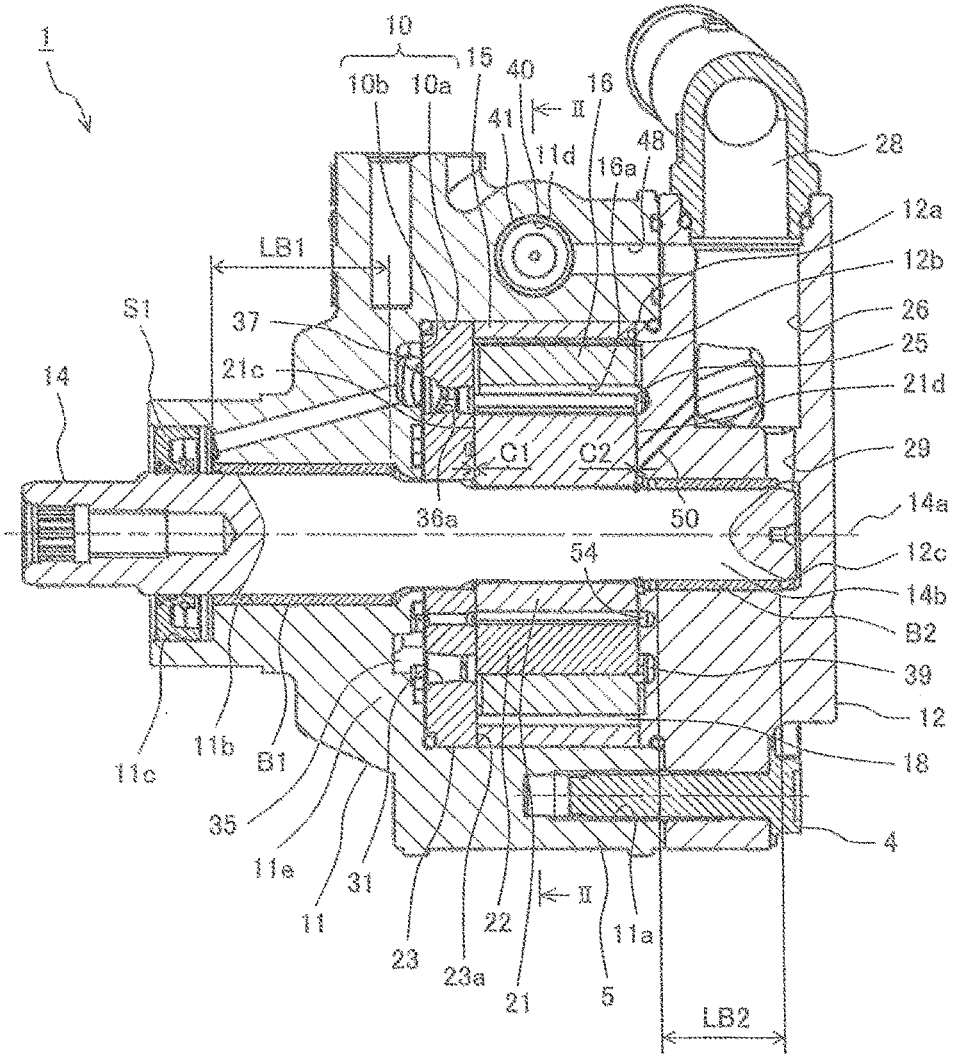
FIG. 6 is a sectional view showing a variation in which a part of configurations is varied in the variable displacement vane pump of FIG. 1, by the section similar to FIG. 1.

FIG. 6 is a sectional view showing a variation in which a part of the configuration is varied in the variable displacement vane pump of FIG. 1, by the section similar to FIG. 1.

In this embodiment, the rear body 12 of the pump housing includes a bypass passage 50. The bypass passage 50 connects the receiving space 10 and the suction passage (the first port 25, the suction hole 26, and the suction passage portion 28). Accordingly, it is possible to rapidly return the hydraulic fluid on the second bearing B2 side to the suction passage. Consequently, it is possible to further decrease the flow amount of the hydraulic fluid to the first lubrication groove B1*c* side.

Figure 7:
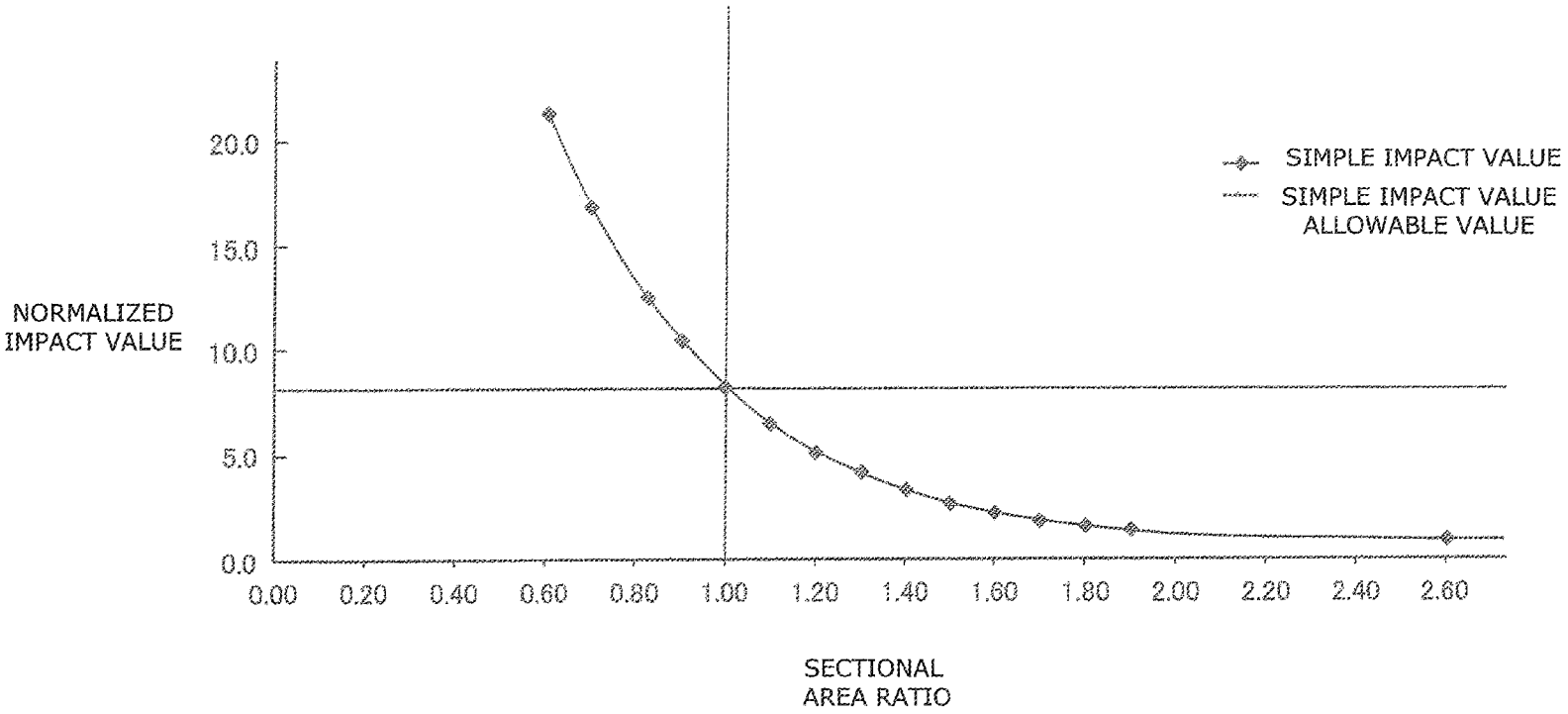
FIG. 7 is a view showing a variation of an impact value with respect to a ratio between a groove sectional area of the second bearing, and a groove sectional area of the first bearing.

FIG. 7 is a view showing a variation of an impact value with respect to a ratio between a groove sectional area of the second bearing and a groove sectional area of the first bearing.

As shown in FIG. 7, the impact value is varied in accordance with a ratio (SB2*c*/SB1*c*) between the sectional area SB2*c* of the second lubrication groove B2*c* and the sectional area SB1*c* of the first lubrication groove B1*c*. The impact value is decreased as the ratio between the sectional area SB2*c* and the sectional area Sb1*c* is greater. However, the decreasing ratio of the impact value is decreased and saturated. In FIG. 7, in a case where the ratio between the sectional area SB2*c* and the sectional area SB1*c* reaches 2.61, the impact value is hardly varied even when the ratio between the sectional area SB2*c* and the sectional area SB1*c* is further increased.

Accordingly, the first lubrication groove B1*c* and the second lubrication groove B2*c* are formed so that the ratio of the sectional areas of the first lubrication groove B1*c* and the second lubrication groove B2*c* which are perpendicular to the rotation axis 14*a* satisfies a following expression 1.

$$2.61 < (\text{the sectional area of the second lubrication groove } B2c)/(\text{the sectional area of the first lubrication groove } B1c) \quad \text{(expression 1)}$$

The first lubrication groove B1*c* and the second lubrication groove B2*c* are designed to satisfy the relationship of the expression 1. With this, it is possible to sufficiently obtain the flow amount decreasing effect of the hydraulic fluid to the first lubrication groove B1*c*, and to suppress the leakage of the hydraulic fluid to the outside of the pump housing.

Besides, the present invention is not limited to the above-described embodiments. A part of the configuration may be deleted. Other configurations which are not described may be added. Moreover, the configurations described in the respective embodiments can be combined to the other embodiment as long as there is no contradiction. By combining the configurations described in the respective embodiments to the other embodiment, the effects of the added configuration are attained in the other embodiment.

For example, following aspects are conceivable as the pump device based on the above-described embodiments.

In one aspect, a pump device includes: a drive shaft; a pump element arranged to be driven and rotated by the drive shaft; a pump housing including; a pump element receiving space receiving the pump element therein, a first bearing receiving space provided on a first side of the pump element receiving space in a direction along a rotation axis of the drive shaft, a second bearing receiving space provided on a second side of the pump element receiving space in the direction along the rotation axis of the drive shaft, a suction passage connected to the pump element receiving space, and arranged to supply a hydraulic fluid to the pump element receiving space in accordance with the rotation of the drive shaft, a discharge passage connected to the pump element receiving space, and arranged to discharge the hydraulic fluid from the pump element receiving space in accordance with the rotation of the drive shaft, a return passage connecting the second bearing receiving space and the suction passage, and a seal receiving space provided outside the first bearing receiving space in a radial direction around the rotation axis, a first bearing which includes a first lubrication groove, which is received within the first bearing receiving space, and which supports the drive shaft; a second bearing which includes a second lubrication groove having a sectional area that is perpendicular to the rotation axis, and that is greater than a sectional area of the first bearing that is perpendicular to the rotation axis, which is received within the second bearing receiving space, and which supports the drive shaft; and a seal member provided within the seal receiving space, and arranged to seal between the drive shaft and the pump housing.

In the pump device according to a preferable aspect, the first bearing and the second bearing are bushes; the second bearing supports the drive shaft in a range of 180 degrees or more in a circumferential direction around the rotation axis.

In another aspect, in one of the aspects of the pump devices, the pump device includes a control valve; the pump element includes a rotor, a plurality of vanes, and a cam ring; the rotor includes a plurality of slits provided in the circumferential direction around the rotation axis, and the rotor is arranged to be driven and rotated by the drive shaft; the plurality of vanes are arranged to be moved, respectively, within the plurality of the slits, the cam ring has an annular shape, and the cam ring is arranged to be moved within the pump element receiving space; the cam ring, the rotor, and the plurality of the vanes form a plurality of pump chambers whose volumes are varied in accordance with the rotation of the drive shaft; the plurality of the pump chambers are arranged to suck the hydraulic fluid from the suction passage in a suction region where the volumes are increased in accordance with the rotation of the drive shaft, and to discharge the hydraulic fluid to the discharge passage in a discharge region where the volumes are decreased in accordance with the rotation of the drive; the suction region is a predetermined region in the circumferential direction around the rotation axis; the discharge region is a predetermined region in the circumferential direction around the rotation axis, on a side opposite to the suction region with respect to the rotation axis in the radial direction around the rotation axis; the pump housing includes a first fluid pressure chamber and a second fluid pressure chamber which are a pair of spaces formed between the cam ring and a circumferential wall of the pump element receiving space in the radial direction; the first fluid pressure chamber is provided on a side on which an internal volume of the first fluid pressure chamber is decreased when the cam ring is moved in a direction in which an eccentric amount between a center of an inner circumference edge of the cam ring and the rotation axis is increased; the second fluid pressure chamber is provided on a side on which an internal volume of the second fluid pressure chamber is increased when the cam ring is moved in a direction in which the eccentric amount between the center of the inner circumference edge of the cam ring and the rotation axis is increased; the control valve is arranged to control the pressure within the first fluid pressure chamber, thereby to move the cam ring, and to variably control an amount of the hydraulic fluid discharged from the discharge region at one rotation of the rotor; and the second lubrication groove of the second bearing is provided on a side identical to the discharge region in the circumferential direction around the rotation axis.

In another aspect, in one of the aspects of the pump devices, the second bearing includes an outer circumference surface which is an outer surface in the radial direction around the rotation axis, and which is fit in the second bearing receiving space in an entire region in the circumferential direction around the rotation axis; and the second lubrication groove is provided only on an inner circumference side which is an inner side in the radial direction around the rotation axis.

In another aspect, in one of the aspects of the pump devices, a length of the first bearing along the rotation axis is longer than a length of the second bearing along the rotation axis.

In another aspect, in one of the aspects of the pump devices, the first lubrication groove has a helical shape.

In another aspect, in one of the aspects of the pump devices, the second lubrication groove has a helical shape; and an inclination angle of a tangent line of the first lubrication groove with respect to the rotation axis is greater than an inclination angle of a tangent line of the second lubrication groove with respect to the rotation axis.

In another aspect, in one of the aspects of the pump devices, an inside diameter of the first bearing in the radial direction around the rotation axis is greater than an inside diameter of the second bearing in the radial direction around the rotation axis.

In another aspect, in one of the aspects of the pump devices, a distance of a gap between the first bearing and an outer circumference surface of the drive shaft in the radial direction around the rotation axis is greater than a distance of a gap between the second bearing and the outer circumference surface of the drive shaft in the radial direction around the rotation axis.

In another aspect, in one of the aspects of the pump devices, the pump housing includes a bypass passage; and the bypass passage connects the pump element receiving space and the suction passage.

In another aspect, in one of the aspects of the pump devices, the first lubrication groove and the second lubrication groove are formed so that (the sectional area of the second lubrication groove)/(the sectional area of the first lubrication groove) which is a ratio between a sectional area of a section of the first lubrication groove which is perpendicular to the rotation axis, and a sectional area of a section of the second lubrication groove which is perpendicular to the rotation axis is greater than 2.61.

The invention claimed is:

1. A pump comprising:

a drive shaft;

a rotor, a plurality of vanes, and a cam ring arranged to be driven and rotated by the drive shaft;

a pump housing including;

a pump receiving space receiving the rotor, the plurality of vanes, and the cam ring therein, a first bearing receiving space provided on a first side of the pump receiving space in a direction along a rotation axis of the drive shaft, a second bearing receiving space provided on a second side of the pump receiving space in the direction along the rotation axis of the drive shaft, a suction passage connected to the pump receiving space, and arranged to supply a hydraulic fluid to the pump receiving space in accordance with the rotation of the drive shaft, a discharge passage connected to the pump receiving space, and arranged to discharge the hydraulic fluid from the pump receiving space in accordance with the rotation of the drive shaft, a return passage connecting the second bearing receiving space and the suction passage, and a seal receiving space provided outside the first bearing receiving space in a radial direction around the rotation axis, a first bearing which includes a first lubrication groove, which is received within the first bearing receiving space, and which supports the drive shaft;

a second bearing which includes a second lubrication groove having a sectional area that is perpendicular to the rotation axis, and that is greater than a sectional area of the first lubrication groove that is perpendicular to the rotation axis, which is received within the second bearing receiving space, and which supports the drive shaft so that excess hydraulic fluid flows into the second lubrication groove and the hydraulic fluid is prevented from leaking to the outside of the pump housing from a seal; and the seal, which is provided within the seal receiving space, and is arranged to seal between the drive shaft and the pump housing.

2. The pump as claimed in claim 1, wherein the first bearing and the second bearing are bushes; the second bearing supports the drive shaft in a range of 180 degrees or more in a circumferential direction around the rotation axis.

3. The pump as claimed in claim 2, further comprising a control valve, wherein:

the rotor includes a plurality of slits provided in the circumferential direction around the rotation axis, and the rotor is arranged to be driven and rotated by the drive shaft;

the plurality of vanes are arranged to be moved, respectively, within the plurality of the slits, the cam ring has an annular shape, and the cam ring is arranged to be moved within the pump receiving space;

the cam ring, the rotor, and the plurality of the vanes form a plurality of pump chambers whose volumes are varied in accordance with the rotation of the drive shaft;

the plurality of the pump chambers are arranged to suck the hydraulic fluid from the suction passage in a suction region where the volumes are increased in accordance with the rotation of the drive shaft, and to discharge the hydraulic fluid to the discharge passage in a discharge region where the volumes are decreased in accordance with the rotation of the drive;

the suction region is a predetermined region in the circumferential direction around the rotation axis;

the discharge region is a predetermined region in the circumferential direction around the rotation axis, on a side opposite to the suction region with respect to the rotation axis in the radial direction around the rotation axis;

the pump housing includes a first fluid pressure chamber and a second fluid pressure chamber which are a pair of spaces formed between the cam ring and a circumferential wall of the pump receiving space in the radial direction;

the first fluid pressure chamber is provided on a side on which an internal volume of the first fluid pressure chamber is decreased when the cam ring is moved in a direction in which an eccentric amount between a center of an inner circumference edge of the cam ring and the rotation axis is increased;

the second fluid pressure chamber is provided on a side on which an internal volume of the second fluid pressure chamber is increased when the cam ring is moved in a direction in which the eccentric amount between the center of the inner circumference edge of the cam ring and the rotation axis is increased;

the control valve is arranged to control the pressure within the first fluid pressure chamber, thereby to move the cam ring, and to variably control an amount of the hydraulic fluid discharged from the discharge region at one rotation of the rotor; and the second lubrication groove of the second bearing is provided on a side identical to the discharge region in the circumferential direction around the rotation axis.

4. The pump as claimed in claim 1, wherein the second bearing includes an outer circumference surface which is an outer surface in the radial direction around the rotation axis, and which is fit in the second bearing receiving space in an entire region in the circumferential direction around the rotation axis; and the second lubrication groove is provided only on an inner circumference side which is an inner side in the radial direction around the rotation axis.

5. The pump as claimed in claim 1, wherein a length of the first bearing along the rotation axis is longer than a length of the second bearing along the rotation axis.

6. The pump as claimed in claim 5, wherein the first lubrication groove has a helical shape.

7. The pump as claimed in claim 6, wherein the second lubrication groove has a helical shape; and an inclination angle of a tangent line of the first lubrication groove with respect to the rotation axis is greater than an inclination angle of a tangent line of the second lubrication groove with respect to the rotation axis.

8. The pump as claimed in claim 1, wherein an inside diameter of the first bearing in the radial direction around the rotation axis is greater than an inside diameter of the second bearing in the radial direction around the rotation axis.

9. The pump as claimed in claim 1, wherein a distance of a gap between the first bearing and an outer circumference surface of the drive shaft in the radial direction around the rotation axis is greater than a distance of a gap between the second bearing and the outer circumference surface of the drive shaft in the radial direction around the rotation axis.

10. The pump as claimed in claim 1, wherein the pump housing includes a bypass passage; and the bypass passage connects the pump receiving space and the suction passage.

11. The pump as claimed in claim 1, wherein the first lubrication groove and the second lubrication groove are formed so that (the sectional area of the second lubrication groove)/(the sectional area of the first lubrication groove)

which is a ratio between a sectional area of a section of the second lubrication groove which is perpendicular to the rotation axis, and a sectional area of a section of the first lubrication groove which is perpendicular to the rotation axis is greater than 2.61.

* * * * *